United States Patent [19]

Shapiro

[11] 4,109,321

[45] Aug. 29, 1978

[54] SCARF CONSTRUCTIONS HAVING A SUBSTANTIALLY CONCEALABLE POCKET THEREIN, AND METHODS OF PRODUCING SAME

[76] Inventor: Rosella Shapiro, 3530 N. Lake Shore Dr., Chicago, Ill. 60657

[21] Appl. No.: 756,346

[22] Filed: Jan. 3, 1977

[51] Int. Cl.[2] ..... A41D 23/00

[52] U.S. Cl. ..... 2/91

[58] Field of Search ..... 2/91, 203, 247, 160, 2/251

[56] References Cited

U.S. PATENT DOCUMENTS

| | | | |
|---|---|---|---|
| 1,936,045 | 11/1933 | Bachrach | 2/91 |
| 2,072,030 | 2/1937 | Damron | 2/247 X |
| 2,097,975 | 11/1937 | Habegger | 2/247 |
| 2,103,594 | 12/1937 | Murray | 2/247 X |
| 2,359,012 | 9/1944 | Sophier | 2/247 |
| 2,544,840 | 3/1951 | Kowatsch | 2/247 UX |
| 2,680,851 | 6/1954 | Vallone | 2/247 X |
| 2,870,448 | 1/1959 | Rosenthal | 2/91 |
| 3,149,343 | 9/1964 | Jacobson | 2/247 X |
| 3,206,765 | 9/1965 | Sherman | 2/91 X |
| 3,217,335 | 11/1965 | Bell | 2/247 X |

FOREIGN PATENT DOCUMENTS

| | | | |
|---|---|---|---|
| 11,159 of | 1913 | United Kingdom | 2/207 |

*Primary Examiner*—Werner H. Schroeder
*Assistant Examiner*—Moshe I. Cohen
*Attorney, Agent, or Firm*—Merriam, Marshall & Bicknell

[57] ABSTRACT

Improved scarf constructions having a concealable pocket or purse therein or as a part thereof, and improved methods of producing or fabricating same. Those improved scarf constructions distinctly and uniquely provide fashionable and useful wearing apparel in the form of a simple and attractive scarf construction that may be formed of a variety of textiles or fabric having an attractive or decorative appearance, and, at the same time, provide convenient means (e.g., security means) for concealing from others the fact that various items or valuables are retained in or by such scarfs, or may be inserted therein or removed therefrom, as desired.

39 Claims, 9 Drawing Figures

SCARF CONSTRUCTIONS HAVING A SUBSTANTIALLY CONCEALABLE POCKET THEREIN, AND METHODS OF PRODUCING SAME

This invention relates to improved scarf constructions having a concealable pocket or purse therein or as a part thereof, and improved methods of producing or fabricating such improved scarf constructions.

An important need exists for being able to conveniently and safely carry, on the person, money, credit cards, or a variety of other items or valuables normally retained, for example, in purses or wallets, and, more particularly, for providing means for conveniently and safely carrying such items on the person during athletic (e.g., tennis, golf, skiing, bowling, boating or the like), social, business or other activities, while concealing from others the fact that such items are retained on the person in the form of wearing apparel not usually associated with the retention of such items.

My improved scarf constructions distinctly and uniquely meet those needs, provide fashionable and useful wearing apparel in the form of a simple and attractive scarf construction that may be formed of a variety of textiles or fabric having an attractive or decorative appearance, and, at the same time, provide convenient means (e.g., security means) for concealing from others the fact that various items or valuables are retained in or by such scarfs, or may be inserted therein or removed therefrom, as desired. Although my improved scarf constructions are particularly well adapted for use by women throughout the seasons of the year and during a variety of climatic conditions, they are also particularly well suited for use by men during the winter or cooler months of the year.

The pocket or purse compartment of the scarf construction is positioned and constructed so as to facilitate essentially concealing, from others, its presence when the scarf is being worn.

Furthermore, my improved scarf constructions may be conveniently, simply and economically made or fabricated in accordance with my improved methods.

In the accompanying diagrammatic drawings:

FIG. 1 is a plan view showing the entire length of the bottom or lower side of an illustrative embodiment of my scarf construction (the bottom side is essentially not seen by others when the scarf is being worn with the bottom side positioned or facing inwardly towards the wearer, thereby exposing the upper side, or a portion thereof); showing its elongated shape, opposed outer ends extending across the width of the scarf, and opposed, longitudinal side edges, each of which side edge has a blind stitch rolled edge extending along the length of the scarf; and, showing, at one end thereof, first and second, shorter lengths of overlapping fabric, which, in conjunction with an elongated length of directly underlapping fabric, provide a pocket at one end of the scarf. A plan view showing the entire length of the upper side of that scarf construction, although not shown as such in the drawings, would not show the first and/or second, shorter lengths of fabric, thereby facilitating concealing from others, when the scarf is being worn, the presence of a pocket or purse compartment. The concealment is further facilitated by positioning the pocket or purse compartment at an end of the scarf (by so-positioning the pocket, when the scarf is being worn the pocket should not be readily visible to others);

Figures 1, 2, 3, 4, 5, 6, 7, 8, 9:
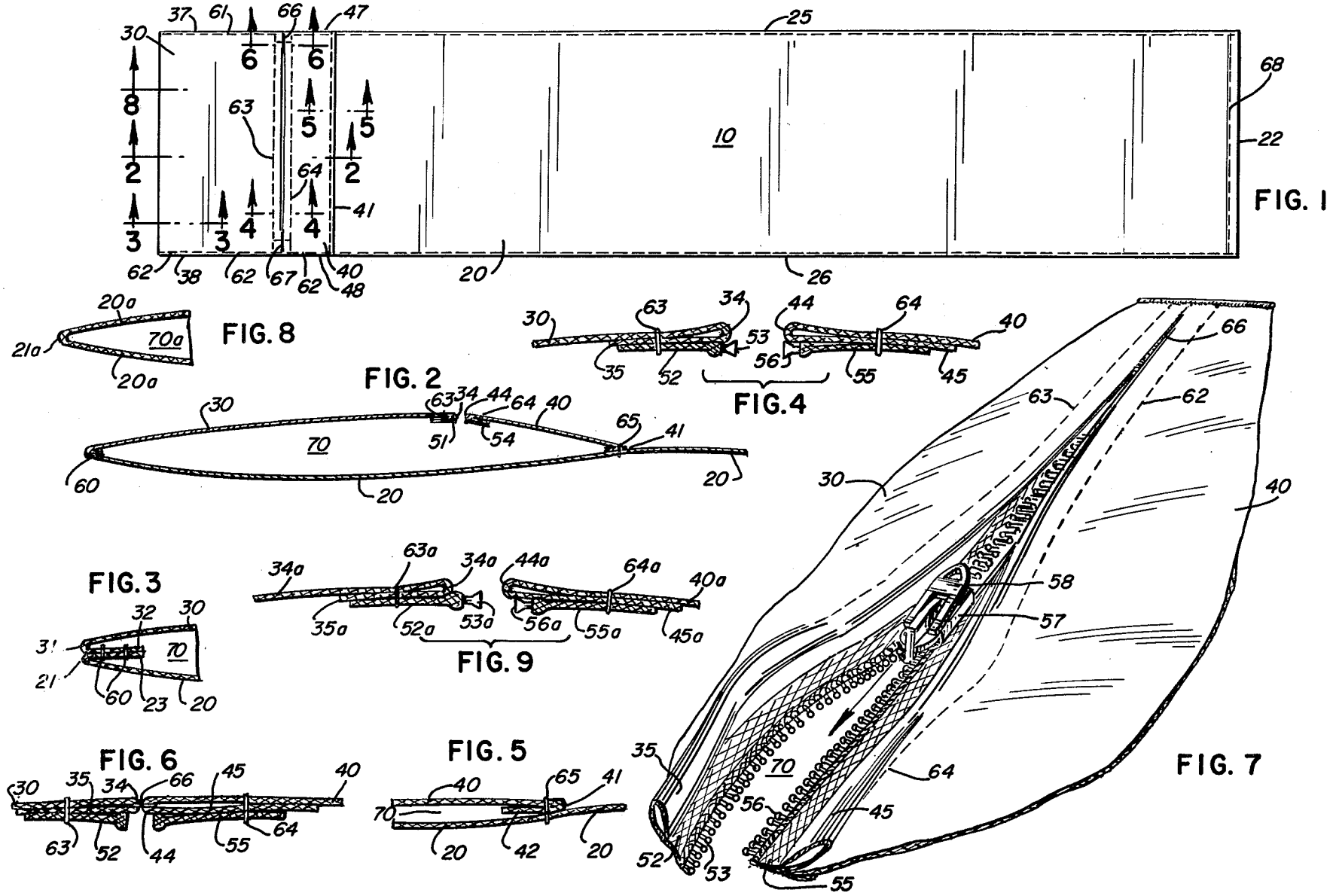
FIG. 2 is an enlarged, fragmentary, cross-sectional view of that embodiment taken along the line 2—2 of FIG. 1 and, for illustrative purposes, shows a partly expanded pocket at one end of the scarf.
FIG. 3 is an enlarged, fragmentary, cross-sectional view of that embodiment taken along the line 3—3 of FIG. 1, and shows an outer end of the scarf and an outer end of the pocket thereof.

FIG. 4 is an enlarged, fragmentary, cross-sectional view of that embodiment taken along the line 4—4 of FIG. 1, and shows certain details of a zipper assembly in which a pair of zipper tapes are shown in relationship to the folded, inner end portions of the first and second, shorter lengths of fabric to which those respective tapes are secured or stitched (one zipper tape is secured to one folded, inner end portion and the other zipper tape is secured to the other folded, inner end portion);

FIG. 5 is an enlarged, fragmentary, cross sectional view of that embodiment taken along the line 5—5 of FIG. 1, and shows an inner end of the pocket;

FIG. 6 is an enlarged, fragmentary, cross-sectional view of that embodiment taken along the line 6—6 of FIG. 1, and shows certain details of the securement of the folded, inner ends of the first and second, shorter lengths of fabric to each other near and at one of the side edges of the scarf (the structure near and at the other side of the scarf is the same);

FIG. 7 is an enlarged, fragmentary, perspective view of that embodiment (showing the structure of FIGS. 4 and 6) with portions folded partly back for purposes of showing certain details of the zipper assembly near and at one of the sides of the scarf (the structure near and at the other side of the scarf is the same);

FIG. 8 is a fragmentary, cross-sectional view, similar to FIG. 3, showing part of another illustrative embodiment of my scarf construction, which other embodiment essentially corresponds with that shown in FIGS. 1 to 7, except that the overlapping outer end thereof is formed by folding a longitudinal length of a single or integral, elongated length of fabric, as shown in FIG. 8, to provide both an elongated length of fabric and first, shorter length of fabric, instead of by stitching together separate longitudinal lengths of different or separate fabric, such as shown in FIGS. 2 and 3; and, FIG. 9 is a fragmentary, cross-sectional view, similar to FIG. 4, showing a zipper assembly in which a pair of zipper tapes are shown in another, so-called staggered relationship with respect to the folded, inner end portions of the first and second, shorter lengths of fabric to which those respective tapes are secured or stitched (one zipper tape is secured to one folded, inner end portion and the other zipper tape is secured to the other folded, inner end portion).

Referring next to those drawings in added detail, particularly FIGS. 1 to 7, the improved fabric scarf construction 10 illustrated therein has a substantially concealable purse, or pocket 70 thereof, provided within the confines of overlapping fabric and positioned at or in the vicinity of at least one end of the scarf. Although FIG. 1, a bottom plan view of the scarf, shows the overlapping lengths of fabric which provide the pocket structure, the pocket structure is not visible from a top plan view of the scarf, particularly when the outer ends of the scarf are covered by clothing.

A variety of multi- or solid-colored, natural and/or synthetic textiles or fabric may be used, including those formed of synthetic resinous yarn, fibers or sheets of polyester, nylon, Dacron or the like, natural yarn or fibers formed of wool or cotton, and suitable blends of such materials.

In providing, for example, a generally rectangular, elongated scarf 10 having such construction, a longitudinal length of elongated fabric 20 of generally rectangular shape having opposed, spaced-apart outer ends 21, 22 and opposed, spaced-apart, longitudinal side edges 25, 26 is positioned at the outer ends and side edges, respectively, of the scarf 10. If desired, the entire length of each of the longitudinal side edges of the scarf may have a blind stitch rolled edge, as shown in FIG. 1.

A first, shorter length of fabric 30 of generally rectangular shape having opposed, spaced-apart, outer and inner ends 31 and 34, respectively, and opposed, spaced-apart, longitudinal side edges 37 and 38, respectively, is positioned at an end of the elongated fabric 20 in overlapping relationship with only a relatively short part of the overall longitudinal length of the elongated fabric 20. The first, shorter length of fabric 30 has the same transverse width as that of the underlapping portion of the elongated fabric 20 and extends thereacross, so that the overlapping outer end 31, 21 and overlapping, longitudinal side edges 37, 25 and 38, 26 of the overlapping lengths of fabric 30, 20 are positioned at an outer end of the scarf and along a portion of the lengths of the opposed, longitudinal side edges of the scarf.

The overlapping outer end 31, 21 of those overlapping, longitudinal lengths of fabric 30, 20 are secured together or connected at and across the outer end of the scarf, for example, by stitching 60.

As shown in FIG. 8, the elongated length of fabric and the first, shorter length of fabric may both be formed from the same single or integral length of elongated fabric **20*a* by folding back a length of a single or integral, elongated length of fabric 20*a* thereacross at a folded outer end 21*a* of the scarf, whereby the overlapping outer end of the resultant overlapping fabric formed as a result of that fold is thereby connected (i.e., integrally connected) at the edge of that fold 20*a* and at an outer end of the scarf, and, the overlapping fabric provide an outer end of the pocket 70*a***.

Referring to FIGS. 2 and 3, and, more particularly to FIG. 3, the outer end 21 of the elongated fabric 20 and the outer end 31 of the overlapping, first, shorter length of fabric 30 may be formed of separate pieces or lengths of fabric which are secured together at and across the outer end of the scarf by stitching 60 or the like. For example, a short length of the ouer end of the elongated fabric 20 and a short length of the outer end of the separate, first, shorter length of fabric 30 may each be folded back thereacross at 21 and 31, respectively, so that the folded, outer end portion 23 of the elongated fabric 20 is positioned above the remaining length of that fabric, the folded, outer end portion 32 of the first, shorter length of fabric 30 is positioned below the remaining length of that fabric, and the first, shorter length of fabric overlaps the elongated fabric. The folded, outer, overlapping end portions 23, 32 are secured together by being stitched thereat, so that the stitching 60 extends entirely across the scarf at an end thereof.

Similarly, as shown in FIG. 4, the inner end of the first, shorter length of fabric 30 is formed by being folded back at 34 thereacross and in underlapping relationship with only part of the remaining length thereof to thereby provide a folded, inner end portion 35.

A length of a conventional first, elongated zipper tape 51 (see FIG. 2) having adjoining outer and inner side edges formed of fabric 52 and zipper teeth 53 (see FIG. 4), respectively, is associated with and positioned in substantially underlapping relationship with the folded, underlapping, inner end portion 35 of the first, shorter length of fabric 30. That zipper tape 51 extends partly or substantially,, but not entirely, across that associated folded, inner end portion 35. The length of the zipper teeth 53 transversely extends across the scarf intermediate the opposed side edges thereof (see FIG. 7) and is positioned inwardly (inwardly relative to the outer end 31 of the first, shorter length of fabric 30) of the adjoining length of the outer side edge of fabric 52 of the first zipper tape 51.

The outer side edge of fabric 52 (outwardly of the inner side edge of zipper teeth 53) of the first zipper tape 51 and the associated folded, inner end portion 35 of the first, shorter length of fabric 30 are secured together or connected substantially thereat by suitable means, such as stitching 63. That stitching 63 extends entirely across the scarf, regardless of the length of the elongated zipper tape 51.

The opposed, longitudinal, side edges of the overlapping fabric formed by the elongated fabric 20 and the first, shorter length of fabric 30 are secured together or connected substantially thereat by suitable means, such as stitching 61, 62.

A second, shorter length of fabric 40 of generally rectangular shape having opposed, spaced-apart, outer and inner ends 41 and 44, respectively, and opposed, spaced-apart, longitudinal side edges 47 and 48, respectively, is positioned substantially contiguous (e.g., adjacent, close or next to, or touching) to the inner end 34 of the first, shorter length of fabric 30 (see FIGS. 1, 2, 4, 6 and 7), and is positioned in overlapping relationship with only a relatively short part of the longitudinal length of the elongated fabric 20 not overlapped by the first, shorter length of fabric 30 (see FIG. 1). The second, shorter length of fabric 40 has the same transverse width as that of the underlapping portion of the elongated fabric 20 and extends thereacross, so that the overlapping, opposed, longitudinal side edges of the overlapping fabric are positioned at and along a portion of the lengths of the opposed, longitudinal side edges of the scarf 10.

As shown in FIG. 5, the outer end of the second, shorter length of fabric 40 is formed by being folded back at 40 thereacross in underlapping relationship and secured or connected thereat by suitable means, such as stitching 65, to the elongated fabric 20 overlapped thereby. The elongated fabric 20 extends longitudinally outwardly a substantial longitudinal length beyond and below the outer end 41 of the second, shorter length of fabric 40 (without being directly overlapped by the second, shorter length of fabric) to the other end 22 of that fabric and the scarf 10 in the manner shown in FIGS. 1 and 5.

The outer end 22 of the elongated fabric 20 is formed by being folded back at 22 thereacross a shorter length in overlapping relationship with only part of the remaining length thereof to thereby provide a short, folded, outer end portion or hem that is stitched 68.

Referring to FIG. 4, the inner end of the second, shorter length of fabric 40 is formed by being folded back at 44 thereacross a short length in underlapping relationship with only part of the remaining length thereof to thereby provide a folded, inner end portion 45 thereof, which is positioned substantially contiguous to or in substantially abutting relationship with the folded, inner end portion 34 across the entire width of the scarf.

A length of a conventional second, elongated zipper tape 54 (see FIG. 2) having adjoining outer and inner side edges formed of fabric 55 and zipper teeth 56 (see FIG. 4), respectively, is associated with and positioned in substantially underlapping relationship with the folded, underlapping, inner end portion 45 of the second, shorter length of fabric 40. The second zipper tape 54 extends partly or substantially, but not entirely, across that associated folded, inner end portion 45. The length of the zipper teeth 56 transversely extends across the scarf intermediate the opposed side edges thereof (see FIG. 7) and is positioned inwardly (inwardly relative to the outer end 41 of the second, shorter length of fabric 40) of the adjoining length of the outer side edge of fabric 55 of the second zipper tape 54. The length of the zipper teeth 56 of the second zipper tape 54 is coextensive with and is of the same length as the length of the zipper teeth 53 of the first zipper tape 51. Moreover, the zipper tapes are positioned and secured to the folded, inner end portions 35, 45 in a similar manner.

Referring to FIG. 7, each of the lengths of zipper tapes 51 and 54, as purchased, is constructed in cooperative, associated and interconnected, as well as interconnectable, relationship with the other zipper tape. The zipper teeth of the first and second pair of conventional zipper tapes are constructed, positioned and adapted to be placed in operative relationship with each other, so that the zipper teeth 53, 56 of both zipper tapes 51, 54 may be selectively and operatively interconnected and disconnected, as desired.

The outer side edge of fabric 55 (outwardly of the inner side edge of zipper teeth 56) of the second zipper tape 54 and the associated folded, inner end portion 45 of the second, shorter length of fabric 40 are secured together or connected substantially thereat by suitable means, such as by stitching 64. That stitching 64 extends entirely across the scarf, regardless of the length of the elongated zipper tape 54.

The opposed, longitudinal side edges of the overlapping fabric formed by the elongated fabric 20 and the second, shorter length of fabric 40 are secured together or connected substantially thereat by suitable means, such as stitching 61, 62.

The transverse lengths of the folded, inner end portions 35, 45 of both the first and second, shorter lengths of fabric 30, 40 extend transversely, substantially across the scarf, and are constructed, positioned and adapted to be placed in substantially contiguous relationship to each other (e.g., adjacent, close or next to, or touching), as shown in FIGS. 1, 2, 4 and 6, and, together, to substantially overhang and thereby substantially conceal from view the zipper teeth of the first and second zipper tapes when those zipper teeth are selectively interconnected (see FIG. 1).

The outer, spaced-apart, transverse lengths of the substantially contiguous (e.g., adjacent, close or next to, or touching), folded, inner end portions 35, 45 of both the first and second, shorter lengths of fabric 30, 40 which extend transversely outwardly beyond the outer ends of the interconnectable length of zipper teeth 53, 56 to the associated longitudinal side edges of the scarf, are secured together or are interconnected or connected to each other along those spaced-apart lengths by suitable means (see FIG. 7), such as stitching 66, 67. That securement by the stitching 66, 67 occurs at or in the immediate vicinity of the edges 34, 44 of the substantially contiguous (e.g., adjacent, close or next to, or touching) folds of the inner end portions of the first and second, shorter lengths of fabric 30, 40. More particularly, the transverse edges of the respective folds of the folded, inner end portions 35, 45 of the first and second, shorter lengths of fabric 30, 40 are positioned in transverse, substantially abutting (e.g., adjacent, close or next to, or touching) relationship with respect to the other, and those substantially abutting edges are essentially permanently secured, connected or stitched to each other (see the stitching 66, 67 in FIG. 1 and stitching 66 in FIGS. 6 and 7) along the relatively short, transverse lengths thereof, thereby leaving a continuous, major intermediate portion of the transverse length of the substantially abutting or substantially contiguous edges unsecured to each other (see FIGS. 1, 4 and 7). That transverse intermediate length, however, may be selectively closed or interconnected, as well as opened or disconnected, by means of the transverse length of the interconnectable zipper teeth 53, 56 (see FIG. 7).

A substantially concealable purse, or pocket thereof 70, is provided by and within the confines of the overlapping fabric formed by the elongated fabric 20 and the first and second, shorter lengths of fabric 30, 40. The pocket 70 has a selectively closable opening (see FIG. 7) at the bottom or lower side of the scarf, which is provided by the transverse length of the interconnectable zipper teeth 53, 56 of the first and second zipper tapes 51, 54, and through which opening an article may be selectively inserted into and withdrawn from the confines of the pocket. That opening is capable of being closed and opened upon the selective closing and opening of the interconnectable zipper teeth (see FIG. 7) to thereby selectively close and open the pocket and the purse.

The interconnectable zipper teeth 53, 56 of the pair of conventional, first and second zipper tapes 51, 54 are capable of being selectively interconnected by being intermeshed in closed, interlocking relationship and disconnected and opened by being unmeshed in separated relationship. Each of the interconnectable zipper teeth has conventional stop means (not shown) associated therewith at the outer ends thereof. The stop means limit further movement of a zipper slide member, as desired. As shown in FIG. 7, a conventional zipper slide member 57 is operatively associated with the interconnectable zipper teeth 53, 56 and is selectively slidable with respect thereto and along a length thereof. The slide member 57 is constructed and operatively associated with the pair of zipper teeth 53, 56 so as to selectively and alternatively effect the intermeshing and unmeshing of the zipper teeth along at least part of the substantially coextensive length thereof. Accordingly, the sliding movement of the slide member causes the slide member to be selectively and slidably advanced or returned to selectively fasten or unfasten the opening and thereby selectively provide ready access to desired or inserted contents of the pocket. A conventional handle 58 may be operatively connected to the slide member 58 to facilitate the sliding movement of the slide member.

In FIG. 1, the longitudinal length of the first, shorter length of fabric 30 is shown to be substantially longer than that of the second, shorter length of fabric 40, and the longitudinal length of each of the first and second, shorter lengths of fabric is shown to be substantially shorter than the overall, longitudinal length of the scarf. Moreover, the longitudinal length of the elongated fabric 30 that is directly overlapped by both the first and second, shorter lengths of fabric 30, 40 is shown to be substantially shorter than that portion of the elongated fabric which is not directly overlapped thereby.

If desired, the longitudinal length of the first, shorter length of fabric 30 may be the same or shorter than that of the second, shorter length of fabric 40. If desired, the side edges of the overlapping, second, shorter length of fabric may be folded and stitched thereat to the elongated fabric, regardless of how the first, shorter length of fabric is formed (see FIGS. 3 and 8).

Although the particular scarf construction illustrated in the drawings shows the pocket positioned at or near only one of the ends of the scarf, if desired, similar pockets, or pocket or purse constructions may be positioned at or near both ends of an elongated or rectangular scarf.

It is preferred that the interconnectable zipper teeth be narrow, thin and formed of a suitable synthetic resinous material such as nylon. The slide member and handle may also be formed of a synthetic resin such as nylon.

When the scarf is of a solid color, the zipper tapes, including their outer side edges of fabric and inner side edges of zipper teeth, and the slide member and handle, may be of the same solid color. Accordingly, the color of the zipper may conform with that of the elongated length of fabric and first and second, shorter lengths of fabric.

Although it is preferred that the length of interconnectable zipper teeth of the pair of zipper tapes by similarly positioned with respect to the edges of the folds of the associated, folded, inner end portions to which the respective zipper tapes are secured, connected, or stitched, such as shown in FIG. 4, other suitable arrangements may be used with some satisfaction.

For example, one such modified arrangement is shown in FIG. 9 and involves positioning the zipper teeth 53*a* of the first zipper tape below and beyond the transverse edge 34*a* of the fold or the inner edge of the folded, inner end portion 35*a* associated therewith, and positioning the transverse edge 44*a* of the fold or the inner edge of the other folded, inner end portion 45*a* below and beyond the zipper teeth 56*a* of the second zipper tape associated therewith, thereby providing zipper tapes which are positioned in a so-called staggered relationship with respect to the transverse edges 34*a*, 44*a* of the folds of the folded, inner end portions 35*a*, 45*a*. When the interconnectable zipper teeth 53*a*, 56*a* of such so-called staggered zipper tapes are operatively interconnected, one folded, inner end portion 45*a* substantially overhangs the zipper teeth 53*a* associated with the other folded, inner end portion 35*a* (see FIG. 9); however, in such staggered arrangements, the folded, inner end portions 35*a*, 45*a*, together, are herein considered as substantially overhanging the zipper teeth 53*a*, 56*a* of the interconnected zipper tapes.

Referring to FIG. 9 in added detail, the folded, inner end portion 35*a* of the first, shorter length of fabric 30*a* is shown secured to the fabric 52*a* of the first zipper tape by means of stitching 63*a*, and the folded, inner end portion 45*a* of the second, shorter length of fabric 40*a* is shown secured to the fabric 55*a* of the second zipper tape by means of stitching 64*a*.

In forming and producing the improved, generally rectangular, elongated fabric scarf constructions, discussed above, having a concealable purse or pocket, several procedures, or general or modified methods may be used.

One such method, wherein the elongated fabric and the first, shorter length of fabric are formed from the same or integral, single length of elongated fabric 20*a* and by folding at 21*a* that single or integral length of elongated fabric intermediate its ends (see FIG. 8), involves the following operations, conducted in an appropriate or desired order.

A folded, end portion (herein referred to as a folded, inner end portion) of the longitudinal length of elongated fabric 20*a* of generally uniform, rectangular shape having opposed transverse ends and longitudinal side edges is formed by folding back a short marginal end portion thereof transversely across the fabric in underlapping relationship with only part of the associated, remaining length thereof.

A folded, inner end portion of the second, shorter length of fabric constituting a separate piece of fabric of generally uniform, rectangular shape having spaced-apart transverse ends and longitudinal side edges and substantially the same transverse width as that of the elongated fabric is formed by folding back a short marginal end thereof transversely across that fabric in underlapping relationship with only part of the associated, remaining length thereof.

The transverse folded edges of the respective folds of the folded, inner end portions of the elongated fabric and the second, shorter length of fabric are placed or positioned transversely across the scarf in substantially abutting relationship (e.g., adjacent, close or next to, or touching) with respect to each other, and those edges are essentially permanently secured or stitched to each other along relatively short, transverse lengths thereof (extending transversely, relatively short distances inwardly from each of the substantially abutting, side edges of fabric), so as to leave a continuous, major intermediate portion of the transverse length of the substantially abutting, transverse edges unsecured to each other. (That transversely extending, intermediate length, however, is selectively closed or interconnected, as well as opened or disconnected, by means of interconnectable zipper teeth of the zipper tapes of a conventional zipper.)

In a preferred method of forming the above-mentioned folded, inner end portions and securing the transverse lengths of those folded edges together by stitching in full accordance with or pursuant to the foregoing method, one positions the inner end portions of the elongated fabric and the second, shorter length of fabric in overlapping relationship, so that the transverse fold lines upon which those inner end portions are later folded (to form the folded edges of the respective folded, inner end portions) are positioned transversely across the overlapping fabric in coextensive and overlapping or superimposed relationship with each other. The so-positioned overlapping fabric is stitched together along those superimposed, coextensive transverse lines, and along relatively short, transverse lengths of those overlapping coextensive lines, so that the stitching extends from each of the side edges of the overlapping fabric, transversely inwardly to predetermined spaced-apart points to connect, with such stitching, those lengths of fabric to each other and to leave a continuous intermediate length unstitched. The folded, inner end portions of the so-connected or stitched together elongated fabric and second, shorter length of fabric are then formed, as described above, along the transverse fold lines, so that the folded, underlapping inner end portions extend transversely across the fabric, from which it is formed, in underlapping relationship, and the transverse length of the inner edges of the folds of the folded, inner end portions and in and/or are adapted to be placed in substantially abutting relationship across the width of the scarf.

The respective, associated lengths of conventional elongated zipper tape, each of which length of zipper tape has adjoining outer and inner side edges formed of fabric and zipper teeth, respectively, are transversely placed or positioned in substantially underlapping relationship with the two folded, inner end portions, so that one zipper tape is associated with one folded, inner end portion, and the other zipper tape is associated with the other folded, inner end portion. Each of the zipper tapes, as purchased, is constructed in cooperative, associated and interconnected, as well as interconnectable, relationship with the other zipper tape.

Accordingly, the respective lengths of inner side edges of zipper teeth of the zipper tapes are substantially coextensive and are constructed and are adpated to be positioned in operative interconnecting relationship with each other along the transverse length of the continuous intermediate unstitched portion of unsecured, substantially abutting inner edges of the folds of the folded, inner end portions. Furthermore, one so-positioned zipper tape is positioned and associated below the underlapping portion of one folded, inner end portion, and the other so-positioned zipper tape is positioned and associated below the underlapping portion of the other folded, inner end portion.

The so-positioned or folded, underlapping portion of one folded, inner end portion is transversely secured to its associated remaining length of fabric and, at the same time, to the so-positioned, underlapping, outer side edge of fabric of its associated zipper tape. This securement may be effected by stitching together the so-formed multilayered fabric thereacross and thereat. Furthermore, the so-positioned or folded, underlapping portion of the other folded, inner end portion is transversely secured to its associated remaining length of fabric and, at the same time, to the so-positioned, underlapping, outer side edge of fabric of its associated zipper tape. Similarly, that securement may be effected by stitching together the so-formed multi-layered fabric thereacross and thereat.

Accordingly, a substantially coextensive length of the so-connected, folded, inner end portions of fabric is provided which extends transversely across the scarf. Those folded, inner end portions are constructed, positioned and adapted to be placed in substantially abutting relationship (e.g., adjacent, close or next to, or touching) across the width of the scarf, and, together, to substantially overhang and thereby to substantially conceal from view the inner side edges of zipper teeth of the zipper tapes when those teeth are interconnected.

The first, shorter length of overlapping fabric is formed at one end of the scarf, and the second, shorter length of overlapping fabric is formed and provided next to the inner end of the first, shorter length of fabric, by folding back and thereunder, at one end of the scarf, the elongated fabric transversely thereacross and at a distance spaced a longitudinal length outwardly of the above-mentioned folded, inner end portion formed therefrom. As a result of so-folding back and thereunder, at an end of the scarf, a relatively long, longitudinal length of the elongated fabric, thereby providing (i) a folded edge which transversely extends across the width of the scarf at an outer end thereof, and (ii) the underlapping, resultant or remaining, major longitudinal length of the elongated fabric:

(a) the first, shorter length of fabric is formed or provided from a short part of the original, overall longitudinal length of the elongated fabric and is positioned at one end of the scarf in directly overlapping relationship with a portion of the resultant or remaining, underlapping, major longitudinal length of the elongated fabric;

(b) the second, shorter length of fabric is positioned in directly overlapping relationship with another, intermediate portion of the resultant or remaining, underlapping, major longitudinal length of the elongated fabric; and, (c) another, outer portion of the resultant or remaining, underlapping, major longitudinal length of the elongated fabric is formed or provided, which outer portion is substantially longer than both of the other, directly underlapping portions thereof, is not directly overlapped by the first and/or second, shorter lengths of fabric, and longitudinally extends beyond, as well as below, the outer end of the second, shorter length of fabric towards or to the other end of the scarf.

A short marginal outer end of the second, shorter length of fabric is folded back transversely thereacross in underlapping relationship with only part of the associated, remaining length thereof, to form a folded, outer end portion of the second, shorter length of fabric. That folded, outer end portion is transversely secured to the underlapping, elongated fabric by stitching together the multilayered fabric thereacross and thereat.

The longitudinal side edges of the overlapping fabric formed by the first and second, shorter lengths of fabric and elongated fabric are longitudinally secured by stitching together the overlapping fabric thereat and therealong.

Accordingly, a substantially concealable purse, or pocket thereof, is provided by the overlapping fabric formed by the elongated fabric in conjunction with the first and second, shorter lengths of fabric. The pocket or purse compartment has an opening which is provided by the interconnectable zipper teeth of the associated zipper tapes. That opening and pocket are capable of being opened and closed upon the selective opening and closing of the interconnectable zipper teeth. More particularly, that opening may be fastened and unfastened, as desired, and an article may be selectively inserted through the opening into the confines of the pocket, and withdrawn therefrom.

The interconnectable zipper teeth have a zipper slide member operatively associated or connected therewith and selectively slidable with respect thereto and along a length thereof, so as to selectively and alternatively effect an intermeshing and unmeshing of the substantially contiguous zipper teeth, whereupon the sliding movement of the slide member causes the slide member to be selectively and slidably advanced or returned to selectively fasten or close, or unfasten or open the opening to the pocket or purse at the bottom or lower side of the scarf and thereby selectively provide ready access to desired inserted contents of the pocket or purse.

The resultant scarf construction corresponds with the construction discussed above with respect to FIGS. 1 to 7, as modified by the folded outer end of the scarf illustrated in FIG. 8.

Another method of forming or producing improved, generally rectangular, elongated fabric scarf constructions having a purse or pocket (without folding a length of the single elongated fabric 20*a* to form or provide the first, shorter length of fabric in the manner illustrated in FIG. 8), such as shown in FIGS. 1 to 7, involves the following operations, conducted in an appropriate or desired order:

providing a length of the elongated fabric of generally uniform, rectangular shape having outer ends and longitudinal side edges, which is adapted to be positioned at the outer ends and side edges, respectively, of the scarf;

forming a folded, inner end portion and folded, outer end portion of the first, shorter length of fabric formed of a separate piece of fabric of generally uniform, rectangular shape having transverse ends and longitudinal side edges and substantially the same transverse width as that of the elongated fabric, by folding back short marginal ends thereof transversely across that fabric in underlapping relationship with only part of the associated, remaining length thereof;

forming a folded, inner end portion and folded, outer end portion of the second, shorter length of fabric formed of a separate piece of fabric of generally uniform, rectangular shape having transverse ends and longitudinal side edges and substantially the same transverse width as that of the elongated fabric, by folding back short marginal ends thereof transversely across that fabric in underlapping relationship with only part of the associated, remaining length thereof;

positioning the edges of the respective folds of the folded, inner end portions of the first and second, shorter lengths of fabric in transverse, substantially abutting relationship (e.g., adjacent, close or next to, or touching) with respect to each other, and appropriately securing or stitching those edges to each other along relatively short, transverse lengths thereof (extending transversely, relatively short distances inwardly from each of the substantially abutting, side edges of fabric), so as to leave a continuous, major intermediate portion of the transverse length of the substantially abutting, transverse edges unsecured to each other (a preferred method of forming the folded, inner edge portions and stitching transverse lengths of the folded edges together is described in added detail above);

transversely positioning or placing respective, associated lengths of the conventional elongated zipper tape, each of which length of zipper tape has adjoining outer and inner side edges formed of fabric and zipper teeth, respectively, in substantially underlapping relationship with each of the folded, inner end portions, one zipper tape being associated with one folded, inner end portion, and the other zipper tape being associated with the other folded, inner end portion, so that the respective lengths of inner side edges of zipper teeth of the two zipper tapes are substantially coextensive and are constructed and are adapted to be positioned in operative interconnecting relationship with each other along the transverse length of said continuous, intermediate transverse length of unsecured, substantially abutting inner edges of the folds of said folded, inner end portions, and so that one zipper tape is positioned and associated below the underlapping portion of one folded, inner end portion and the other zipper tape is positioned and associated below the underlapping portion of the other folded, inner end portion;

transversely securing the so-positioned underlapping portion of one folded, inner end portion to its associated, remaining length of fabric and, at the same time, to the so-positioned, underlapping, outer side edge of fabric of its associated zipper tape, by stitching together the so-formed multi-layered fabric thereacross and thereat, and transversely securing the so-positioned underlapping portion of the other folded, inner end portion to its associated, remaining length of fabric and, at the same time, to the so-positioned, underlapping, outer side edge of fabric of its associated zipper tape, by stitching together the so-formed multi-layered fabric thereacross and thereat, thereby providing a substantially coextensive length of folded, inner end portions of fabric which are adapted to extend transversely across the scarf and are constructed, positioned and adapted to be placed in substantially abutting relationship across the width of the scarf and, together, to substantially overhang and thereby substantially conceal from view the zipper teeth of the zipper tapes when those teeth are interconnected;

positioning the so-connected, and substantially coextensive lengths of the first and second, shorter lenghts of fabric, with their folded, underlapping, outer end portions and their associated, underlapping, secured-in-place zipper tapes, in overlapping relationship with a longitudinal length of the elongated fabric and at one end thereof, so that (a) the outer end or folded, outer end portion of the first, shorter length of fabric is positioned at an outer end or folded, outer end portion of the elongated fabric, (b) the other outer end of the elongated fabric extends longitudinally outwardly a substantial length beyond the folded, underlapping, outer end portion of the second, shorter length of fabric (without being directly overlapped by the second, shorter length of fabric), and (c) the overlapping outer end and side edges of the overlapping fabric are positioned at an outer end and side edges, respectively, of the scarf;

securing said so-positioned outer end or folded, outer end portion of the first, shorter length of fabric to the directly underlapping, elongated fabric, including the folded, outer end portion thereof, followed by securing the outer end or folded, outer end portion of the second, shorter length of fabric to the directly underlapping, elongated fabric, by stitching together the overlapping or multilayered fabric thereacross and thereat, and then securing together each of the side edges of the overlapping fabric, at the side edges of the scarf, formed by said first and second, shorter lengths of fabric and said elongated fabric, by stitching together the overlapping fabric thereat and therealong, thereby providing a substantially concealable purse, or pocket thereof, formed from the overlapping fabric provided by said elongated fabric in conjunction with the first and second, shorter lengths of fabric, so that the pocket has an opening which is provided by the interconnectable zipper teeth of the zipper tapes, which opening may be fastened and unfastened, as desired, and through which opening an article may be selectively inserted into and withdrawn from the confines of the pocket; said opening and pocket being capable of being opened and closed upon the selective opening and closing of the interconnectable zipper teeth;

said interconnectable zipper teeth having a zipper slide member operatively associated therewith and selectively slidable with respect thereto and along a length thereof, so as to selectively and alternatively effect an intermeshing and unmeshing of the zipper teeth, whereupon the sliding movement of the slide member causes the slide member to be selectively and slidably advanced or returned to selectively (a) fasten or close, or (b) unfasten or open the opening to the pocket or purse and thereby selectively provide ready access to desired inserted contents of the pocket or purse.

In performing the above methods, as therein described or specified, of producing such improved scarf constructions having a purse or pocket formed therewith or therein, it is desirable, if not important, for example, (1) to secure or stitch the folded, inner end portion of the first, shorter length of fabric, or the folded, inner end portion of the elongated fabric from which it may be formed by folding, and the folded, inner end portion of the second, shorter length of fabric to each other along relatively short, spaced-apart transverse lengths (leaving an intermediate transverse length not stitched together), and to their respective, associated, underlapping zipper tapes, before securing or stitching the outer end of the overlapping, second, shorter length of fabric to the elongated fabric, and/or, in instances wherein the first, shorter length of fabric is not integrally connected to the elongated fabric by and at a fold, before securing or stitching the outer end of the overlapping, first, shorter length of fabric to the elongated fabric, and (2) to secure or stitch the outer end of the over-lapping, second, shorter length of fabric to the elongated fabric, and/or, in instances wherein the first, shorter length of fabric is not integrally connected to the elongated fabric by and at a fold, to secure or stitch the outer end of the overlapping, first, shorter length of fabric to the outer end of the elongated fabric, before securing or stitching the side edges of the overlapping, first and second, shorter lengths of connected fabric to the associated side edges of the underlapping elongated fabric.

The foregoing detailed description has been given for clearness of understanding only, and no unnecessary limitations should be understood therefrom, as modifications will be obvious to those skilled in the art.

What is claimed is:

1. An improved fabric scarf construction having a substantially concealable purse, or pocket thereof, provided within the confines of overlapping fabric and positioned at or in the vicinity of at least one end portion of the scarf, which comprises:

a length of elongated fabric having outer ends and side edges positioned at outer ends and side edges, respectively, of the scarf;

a first, shorter length of fabric having outer and inner ends and side edges; said first, shorter length of fabric being positioned at an end of said elongated fabric in overlapping relationship with only part of the length of said elongated fabric, and having substantially the same width as that of the underlapping portion of said elongated fabric and extending substantially thereacross, so that the overlapping outer end and side edges of the overlapping fabric are positioned at an outer end and side edges, respectively, of the scarf;

said overlapping lengths of fabric being secured together or connected at substantially the outer end of the scarf;

the inner end of said first, shorter length of fabric being folded back substantially thereacross with only part of the remaining length thereof to thereby provide a folded, inner end portion;

a length of a first, elongated zipper tape having adjoining outer and inner edges formed of fabric and zipper teeth, respectively; said first zipper tape being associated with and positioned in substantially underlapping relationship with the folded, inner end portion of said first, shorter length of fabric and extending partly or substantially thereacross with its length of zipper teeth positioned inwardly of the adjoining length of the outer side edge of fabric;

the outer side edge of fabric of said first zipper tape and the associated folded, inner end portion of said first, shorter length of fabirc being secured together or connected substantially thereat;

said side edges of said overlapping fabric formed by said elongated fabric and said first, shorter length of fabric being secured together or connected substantially thereat;

a second, shorter length of fabric having outer and inner ends and side edges; said second, shorter length of fabric being positioned substantially contiguous to the inner end of said first, shorter length of fabric, and being positioned in overlapping relationship with only part of the length of said elongated fabric not overlapped by said first, shorter length of fabric, and having substantially the same width as that of the underlapping portion of said elongated fabric and extending substantially thereacross, so that the overlapping side edges of the overlapping fabric are positioned at side edges of the scarf;

the outer end of said second, shorter length of fabric being secured or connected substantially thereat to said elongated fabric overlapped thereby, and said elongated fabric extending outwardly beyond said outer end of said second, shorter length of fabric;

the inner end of said second, shorter length of fabric being folded back substantially thereacross with only part of the remaining length thereof to thereby provide a folded, inner end portion;

a length of a second, elongated zipper tape having adjoining outer and inner side edges formed of fabric and zipper teeth, respectively; said secnd zipper tape being associated with and positioned in substantially underlapping relationship with the folded, inner end portion of said second, shorter length of fabric and extending partly or substantially thereacross with its length of zipper teeth positioned inwardly of the adjoining length of the outer side edge of fabric of said second zipper tape; the length of the zipper teeth of said second zipper tape being substantially coextensive with the length of the zipper teeth of said first zipper tape;

the zipper teeth of said first and second zipper tapes being constructed, positioned and adapted to be placed in operative relationship with each other, so that the zipper teeth of both of said zipper tapes may be selectively and operatively interconnected and disconnected;

the outer side edge of fabric of said second zipper tape and the associated folded, inner end portion of said second, shorter length of fabric being secured together or connected substantially thereat;

said side edges of the overlapping fabric formed by said elongated fabric and said second, shorter length of fabric being secured together or connected substantially thereat;

the lengths of the folded, inner end portions of both said first and second, shorter lengths of fabric extending substantially across the scarf and being constructed, positioned and adapted to be placed in substantially contiguous relationship to each other and, together, to substantially overhang and thereby substantially conceal from view the zipper teeth of the first and second zipper tapes when those zipper teeth are selectively interconnected;

that portion or portions of the length of the substantially contiguous, folded, inner end portions of both said first and second, shorter lengths of fabric extending outwardly beyond one or both of the outer ends of the interconnectable length of zipper teeth to the associated side edge or edges of the scarf, being secured together of interconnected to each other substantially thereat;

a substantially concealable purse, or pocket thereof, being provided by and within the confines of the overlapping fabric formed by said elongated fabric and first and second, shorter lengths of fabric; said pocket having a selectively closable opening provided by the interconnectable zipper teeth, and through which opening an article may be selectively inserted into and withdrawn from the confines of said pocket; said opening being capable of being opened and closed upon the selective opening and closing of said interconnectable zipper teeth, to thereby selectively open and close said pocket;

said interconnectable zipper teeth being capable of being selectively interconnected by being intermeshed in closed, interlocking relationship and disconnected and opened by being unmeshed in separated relationship; zipper slide member means operatively associated with said interconnectable zipper teeth and being selectively slidable with respect thereto and along a length thereof; said slide member means being constructed and operatively associated with the pair of zipper teeth so as to selectively and alternatively effect the intermeshing and unmeshing of said zipper teeth along at least part of the substantially coextensive length thereof, whereupon said sliding movement of said slide member means causes said slide member means to be selectively and slidably advanced or returned to selectively fasten or unfasten said opening and thereby selectively provide ready access to desired inserted contents of said pocket.

2. The scarf construction of claim 1, wherein said elongated fabric and said first, shorter length of fabric are formed from the same single length of fabric, and said single length of fabric is folded back substantially thereacross at an outer end of said scarf, whereby the overlapping outer end of the resultant overlapping fabric formed as a result of that fold are integrally connected at said fold.

3. The scarf construction of claim 1, wherein said elongated fabric and said first, shorter length of fabric are formed of separate pieces of fabric which are secured together at their overlapping outer end, which overlapping outer end is positioned at an outer end of the scarf.

4. The scarf construction of claim 1, wherein the securing together of fabric is effected by stitching means.

5. The scarf construction of claim 1, wherein the outer end of said second, shorter length of fabric is folded back substantially thereacross a short length, and the resultant outer folded end portion is stitched substantially thereat to the elongated fabric.

6. The scarf construction of claim 1, wherein said portion or portions of the length of the substantially contiguous, folder, inner end portions of both said first and second, shorter lengths of fabric extending outwardly beyond one or both of the outer ends of the interconnectable length of zipper teeth to the associated side edge or edges of the scarf, are secured together or interconnected to each other substantially thereat by stitching said portion or portions of the length together at the inner edges of the substantially contiguous folds of said inner end portions of the first and second, shorter lengths of fabric.

7. The scarf construction of claim 1, wherein the interconnectable zipper teeth of the zipper tapes are formed of nylon.

8. The scarf construction of claim 1, wherein the length of said first, shorter length of fabric is longer than the length of said second, shorter length of fabric.

9. The scarf construction of claim 1, wherein the length of said second, shorter length of fabric is longer than the length of said first, shorter length of fabric.

10. The scarf construction of claim 1, wherein the length of said first, shorter length of fabric is substantially the same as the length of said second, shorter length of fabric.

11. The scarf construction of claim 1, wherein that portion of the pocket which is formed by the overlapping fabric provided by said elongated fabric and said first, shorter length of fabric, is larger than that portion of the pocket which is formed by the overlapping fabric provided by said elongated fabric and said second, shorter length of fabric.

12. The scarf construction of claim 1, wherein that portion of the pocket which is formed by the overlapping fabric provided by said elongated fabric and said second, shorter length of fabric, is larger than that portion of the pocket which is formed by the overlapping fabric provided by said elongated fabric and said first, shorter length of fabric.

13. The scarf construction of claim 1, wherein that portion of the pocket which is formed by the overlapping fabric provided by said elongated fabric and said first, shorter length of fabric, is substantially the same size as that portion of the pocket which is formed by the overlapping fabric provided by said elongated fabric and said second, shorter length of fabric.

14. The scarf construction of claim 1, wherein the length of the interconnectable zipper teeth of said first and second zipper tapes are similarly positioned with respect to the inner edges of the folds of the associated folded, inner end portions to which the respective zipper tapes are secured or connected.

15. The scarf construction of claim 1, wherein the zipper teeth of either said first or second zipper tapes extend inwardly beyond the inner edge of the folded, inner end portion associated therewith, and the inner edge of the other folded, inner end portion extends inwardly beyond the zipper teeth of the zipper tape associated therewith, to provide zipper tapes which are positioned in staggered relationship with respect to the folded, inner end portions, so that when the interconnectable zipper teeth of the staggered zipper tapes are interconnected, one folded, inner end portion substantially overhangs the zipper teeth associated with the other folded, inner end portion.

16. The scarf construction of claim 1, wherein the inner end of each of said first and second, shorter lengths of fabric is formed by being folded back substantially thereacross in underlapping relationship with only part of the remaining length thereof to thereby provide said folded, inner end portion thereof.

17. An improved fabric scarf construction having a substantially concealable purse, or pocket thereof, provided within the confines of overlapping fabric and positioned at or in the vicinity of at least one end portion of the scarf, which comprises:

a length of elongated fabric of generally rectangular shape having opposed, spaced-apart outer ends and opposed, spaced-apart side edges positioned at the outer ends and side edges, respectively, of the scarf;

a first, substantially shorter length of fabric of generally rectangular shape having opposed, spaced-apart outer and inner ends and opposed, spaced-apart side edges; said first, substantially shorter length of fabric being positioned at an end of said elongated fabric in overlapping relationship with only a relatively short part of the length of said elongated fabric, and having substantially the same width as that of the underlapping portion of said elongated fabric and extending substantially thereacross, so that the overlapping outer end and side edges of the overlapping fabric are positioned at an outer end and side edges, respectively, of the scarf;

said overlapping outer end of said overlapping lengths of fabric being secured together or connected at substantially the outer end of the scarf;

the inner end of said first, substantially shorter length of fabric being folded back substantially thereacross with only part of the remaining length thereof to thereby provide a folded, inner end portion;

a length of a first, elongated zipper tape having adjoining outer and inner side edges formed of fabric and zipper teeth, respectively; said first zipper tape being associated with and positioned in substantially underlapping relationship with the folded, inner end portion of said first, substantially shorter length of fabric and extending partly or substantially thereacross with its length of zipper teeth positioned inwardly of the adjoining length of the outer side edge of fabric of said first zipper tape;

the outer side edge of fabric of said first zipper tape and the associated folded, inner end portion of said first, substantially shorter length of fabric being secured together or connected substantially thereat;

said opposed side edges of said overlapping fabric formed by said elongated fabric and said first, substantially shorter length of fabric being secured together or connected substantially thereat;

a second, substantially shorter length of fabric of generally rectangular shape having opposed, spaced-apart outer and inner ends and opposed, spaced-apart side edges; said second, substantially shorter length of fabric being positioned substantially contiguous to the inner end of said first, substantially shorter length of fabric, and being positioned in overlapping relationship with only a relatively short part of the length of said elongated fabric not overlapped by said first, substantially shorter length of fabric, and having substantially the same width as that of the underlapping portion of said elongated fabric and extending substantially thereacross, so that the overlapping, opposed side edges of the overlapping fabric are positioned at opposed side edges of the scarf;

the outer end of said second, substantially shorter length of fabric being secured or connected substantially thereat to said elongated fabric overlapped thereby, and said elongated fabric extending outwardly, a substantial length beyond said outer end of said second, substantially shorter length of fabric to the other end of the elongated fabric;

the inner end of said second, substantially shorter length of fabric being folded back substantially thereacross with only part of the remaining length thereof to thereby provide a folded, inner end portion;

a length of a second, elongated zipper tape having adjoining outer and inner side edges formed of fabric and zipper teeth, respectively; said second zipper tape being associated with and positioned in substantially underlapping relationship with the folded, inner end portion of said second, substantially shorter length of fabric and extending partly or substantially thereacross with its length of zipper teeth positioned inwardly of the adjoining length of the outer side edge of fabric of said second zipper tape; the length of the zipper teeth of said second zipper tape being substantially coextensive with the length of the zipper teeth of said first zipper tape;

the zipper teeth of said first and second zipper tapes being constructed, positioned and adapted to be placed in operative relationship with each other, so that the zipper teeth of both of said zipper tapes may be selectively and operatively interconnected and disconnected;

the outer side edge of fabric of said second zipper tape and the associated folded, inner end portion of said second, substantially shorter length of fabric being secured together or connected substantially thereat;

said opposed side edges of the overlapping fabric formed by said elongated fabric and said second, substantially shorter length of fabric being secured together or connected substantially thereat;

the lengths of the folded, inner end portions of both said first and second, substantially shorter lengths of fabric extending substantially across the scarf and being constructed, positioned and adapted to be placed in substantially contiguous relationship to each other and, together, to substantially overhang and thereby substantially conceal from view the zipper teeth of the first and second zipper tapes when those zipper teeth are selectively interconnected;

that portion or portions of the length of the substantially contiguous, folded, inner end portions of both said first and second, substantially shorter lengths of fabric extending outwardly beyond one or both of the outer ends of the interconnectable length of zipper teeth to the associated side edge or edges of the scarf, being secured together or interconnected to each other substantially thereat;

a substantially concealable purse, or pocket thereof, being provided by and within the confines of the overlapping fabric formed by said elongated fabric and first and second, substantially shorter lengths of fabric; said pocket having a selectively closable opening which is provided by the interconnectable zipper teeth, and through which opening an article may be selectively inserted into and withdrawn from the confines of said pocket; said opening being capable of being opened and closed upon the selective opening and closing of said interconnectable zipper teeth to thereby selectively open and close said pocket;

said interconnectable zipper teeth of said first and second zipper tapes being capable of being selectively interconnected by being intermeshed in closed, interlocking relationship and disconnected and opened by being unmeshed in separated relationship; said interconnectable zipper teeth having stop means associated therewith at the outer ends thereof, which limits further movement of a zipper slide member; a zipper slide member operatively associated with said interconnectable zipper teeth and being selectively slidable with respect thereto and along a length thereof; said slide member being constructed and operatively associated with the pair of zipper teeth so as to selectively and alternatively effect the intermeshing and unmeshing of said zipper teeth along at least part of the substantially coextensive length thereof, whereupon said sliding movement of said slide member causes said slide member to be selectively and slidably advanced or returned to selectively fasten or unfasten said opening and thereby selectively provide ready access to desired inserted contents of said pocket; handle means operatively connected to said slide member to facilitate sliding movement of said slide member.

18. The scarf construction of claim 17, wherein said elongated fabric and said first, substantially shorter length of fabric are formed from the same single length of fabric, and said single length of fabric is folded back substantially thereacross at an outer end of said scarf, whereby the overlapping outer end of the resultant overlapping fabric formed as a result of that fold are integrally connected at said fold.

19. The scarf construction of claim 17, wherein said elongated fabric and said first, substantially shorter length of fabric are formed of separate pieces of fabric which are stitched together at their overlapping outer end, which overlapping outer end is positioned at an outer end of the scarf.

20. The scarf construction of claim 17, wherein said securing together of fabric is effected by stitching means.

21. The scarf construction of claim 17, wherein the outer end of said second, substantially shorter length of fabric is folded back substantially thereacross a short length, and the resultant outer folded end portion is stitched substantially thereat to the elongated fabric.

22. The scarf construction of claim 17, wherein said portion or portions of the length of the substantially contiguous, folded, inner end portions of both said first and second, substantially shorter lengths of fabric extending outwardly beyond one or both of the outer ends of the interconnectable length of zipper teeth to the associated side edge or edges of the scarf, are secured together or interconnected to each other substantially thereat by stitching said portion or portions of the length together at the inner edges of the substantially contiguous folds of said inner end portions of the first and second, substantially shorter lengths of fabric.

23. The scarf construction of claim 17, wherein the interconnectable zipper teeth of the zipper tapes are formed of nylon.

24. The scarf construction of claim 17, wherein the length of said first, substantially shorter length of fabric is substantially longer than the length of said second, substantially shorter length of fabric.

25. The scarf construction of claim 17, wherein the length of said second, substantially shorter length of fabric is substantially longer than the length of said first, substantially shorter length of fabric.

26. The scarf construction of claim 17, wherein the length of said first, substantially shorter length of fabric is substantially the same as the length of said second, substantially shorter length of fabric.

27. The scarf construction of claim 17, wherein that portion of the pocket which is formed by the overlapping fabric provided by said elongated fabric and said first, substantially shorter length of fabric, is substantially larger than that portion of the pocket which is formed by the overlapping fabric provided by said elongated fabric and said second, substantially shorter length of fabric.

28. The scarf construction of claim 17, wherein that portion of the pocket which is formed by the overlapping fabric provided by said elongated fabric and said second, substantially shorter length of fabric, is substantially larger than that portion of the pocket which is formed by the overlapping fabric provided by said elongated fabric and said first, substantially shorter length of fabric.

29. The scarf construction of claim 17, wherein that portion of the pocket which is formed by the overlapping fabric provided by said elongated fabric and said first, substantially shorter length of fabric, is substantially the same size as that portion of the pocket which is formed by the overlapping fabric provided by said elongated fabric and said second, substantially shorter length of fabric.

30. The scarf construction of claim 17, wherein the length of the interconnectable zipper teeth of said first and second zipper tapes are similarly positioned with respect to the inner edges of the folds of the associated folded, inner end portions to which the respective zipper tapes are secured or connected.

31. The scarf construction of claim 17, wherein the zipper teeth of either said first or second zipper tapes extend inwardly beyond the inner edge of the folded, inner end portion associated therewith, and the inner edge of the other folded, inner end portion extends inwardly beyond the zipper teeth of the zipper tape associated therewith, to provide zipper tapes which are positioned in staggered relationship with respect to the folded, inner end portions, so that when the interconnectable zipper teeth of the staggered zipper tapes are interconnected, one folded, inner end portion substantially overhangs the zipper teeth associated with the other folded, inner end portion.

32. The scarf construction of claim 17, wherein the inner end of each of said first and second, substantially shorter lengths of fabric is formed by being folded back substantially thereacross in underlapping relationship with only part of the remaining length thereof to thereby provide said folded, inner end portion thereof.

33. An improved, generally rectangular, elongated fabric scarf construction having a substantially concealable purse, or pocket thereof, provided within the confines of overlapping fabric and positioned at or in the vicinity of at least one end portion of the scarf, which comprises:

a length of elongated fabric of generally rectangular shape having opposed, spaced-apart outer ends and opposed, spaced-apart side edges positioned at the outer ends and side edges, respectively, of the scarf;

a first, substantially shorter length of fabric of generally rectangular shape having opposed, spaced-apart outer and inner ends and opposed, spaced-apart side edges; said first, substantially shorter length of fabric being positioned at an end of said elongated fabric in overlapping relationship with only a relatively short part of the length of said elongated fabric, and having substantially the same width as that of the underlapping portion of said elongated fabric and extending substantially thereacross, so that the overlapping outer end and side edges of the overlapping fabric are positioned at an outer end and side edges, respectively, of the scarf;

said elongated fabric and said first, substantially shorter length of fabric being formed from the same single length of fabric, and said single length of fabric being folded back substantially thereacross at an outer end of said scarf, whereby the overlapping outer end of the resultant overlapping fabric formed as a result of that fold are integrally connected at said fold;

the inner end of said first, substantially shorter length of fabric being folded back substantially thereacross in underlapping relationship with only part of the remaining length thereof to thereby provide a folded, inner end portion;

a length of a first, elongated zipper tape having adjoining outer and inner side edges formed of fabric and nylon zipper teeth, respectively; said first zipper tape being associated with and positioned in substantially underlapping relationship with the folded, underlapping inner end portion of said first, substantially shorter length of fabric and extending substantially thereacross intermediate its opposed side edges with its length of zipper teeth positioned inwardly of the adjoining length of the outer side edge of fabric of said first zipper tape;

the outer side edge of fabric of said first zipper tape and the associated folded, inner end portion of said first, substantially shorter length of fabric being stitched together thereat;

said opposed side edges of said overlapping fabric formed by said elongated fabric and said first, substantially shorter length of fabric being stitched together thereat;

a second, substantially shorter length of fabric of generally rectangular shape having opposed, spaced-apart outer and inner ends and opposed, spaced-apart side edges; the length of said first, substantially shorter length of fabric being longer than that of said second, substantially shorter length of fabric; said second, substantially shorter length of fabric being positioned substantially contiguous to the inner end of said first, substantially shorter length of fabric, and being positioned in overlapping relationship with only a relatively short part of the length of said elongated fabric not overlapped by said first, substantially shorter length of fabric, and having substantially the same width as that of the underlapping portion of said elongated fabric and extending substantially thereacross, so that the overlapping, opposed side edges of the overlapping fabric are positioned at opposed side edges of the scarf;

a short length of the outer end of said second, substantially shorter length of fabric being folded back substantially thereacross in underlapping relationship and stitched thereat to said elongated fabric overlapped thereby, and said elongated fabric extending outwardly, a substantial length beyond said outer end of said second, substantially shorter length of fabric to the other end of said elongated fabric;

the inner end of said second, substantially shorter length of fabric being folded back substantially thereacross in underlapping relationship with only part of the remaining length thereof to thereby provide a folded, inner end portion;

a length of a second, elongated zipper tape having adjoining outer and inner side edges formed of fabric and nylon zipper teeth, respectively; said second zipper tape being associated with and positioned in substantially underlapping relationship with the folded, underlapping, inner end portion of said second, substantially shorter length of fabric and extending substantially thereacross intermediate its opposed side edges with its length of zipper teeth positioned inwardly of the adjoining length of the outer side edge of fabric of said second zipper tape; the length of the zipper teeth of said second zipper tape being substantially coextensive with the length of the zipper teeth of said first zipper tape;

the zipper teeth of said first and second zipper tapes being constructed, positioned and adapted to be placed in operative relationship with each other, so that the zipper teeth of both of said zipper tapes may be selectively and operatively interconnected and disconnected;

the outer side edge of fabric of said second zipper tape and the associated folded, inner end portion of said second, substantially shorter length of fabric being stitched together thereat;

said opposed side edges of the overlapping fabric formed by said elongated fabric and said second, substantially shorter length of fabric being stitched together thereat;

the lengths of the folded, inner end portions of both said first and second, substantially shorter lengths of fabric extending substantially across the scarf and being constructed, positioned and adapted to be placed in substantially contiguous relationship to each other and, together, to substantially overhang and thereby substantially conceal from view the zipper teeth of the first and second zipper tapes when those zipper teeth are selectively interconnected;

the outer, spaced-apart lengths of said substantially contiguous, folded, inner end portions of both said first and second, substantially shorter lengths of fabric which extend outwardly beyond the outer ends of the interconnectable length of zipper teeth to the associated side edges of the scarf, being stitched together at the inner edges of the substantially contiguous folds of said inner end portions of the first and second, substantially shorter lengths of fabric;

a substantially concealable purse, or pocket thereof, being provided by and within the confines of the overlapping fabric formed by said elongated fabric and first and second, substantially shorter lengths of fabric; said pocket having a selectively closable opening which is provided by the interconnectable zipper teeth of said first and second zipper tapes, and through which opening an article may be selectively inserted into and withdrawn from the confines of said pocket; said opening being capable of being opened and closed upon the selective opening and closing of said interconnectable zipper teeth to thereby selectively open and close said pocket;

said interconnectable zipper teeth of said first and second zipper tapes being capable of being selectively interconnected by being intermeshed in closed, interlocking relationship and disconnected and opened by being unmeshed in separated relationship; said interconnectable zipper teeth having stop means associated therewith at the outer ends thereof, which limits further movement of a zipper slide member; a zipper slide member operatively associated with said interconnectable zipper teeth and being selectively slidable with respect thereto and along a length thereof; said slide member being constructed and operatively associated with the pair of zipper teeth so as to selectively and alternatively effect the intermeshing and unmeshing of said zipper teeth along at least part of the substantially coextensive length thereof, whereupon said sliding movement of said slide member causes said slide member to be selectively and slidably advanced or returned to selectively fasten or unfasten said opening and thereby selectively provide ready access to desired inserted contents of said pocket; handle means operatively connected to said slide member to facilitate sliding movement of said slide member.

34. The scarf construction of claim 33, wherein that portion of the pocket which is formed by the overlapping fabric provided by said elongated fabric and said first, substantially shorter length of fabric, is substantially larger than that portion of the pocket which is formed by the overlapping fabric provided by said elongated fabric and said second, substantially shorter length of fabric.

35. The scarf construction of claim 33, wherein the length of the interconnectable zipper teeth of said first and second zipper tapes are similarly positioned with respect to the inner edges of the folds of the associated folded, inner end portions to which the respective zipper tapes are stitched thereto.

36. The scarf construction of claim 33, wherein the zipper teeth of either said first or second zipper tapes extend inwardly beyond the inner edge of the folded, inner end portion associated therewith, and the inner edge of the other folded, inner end portion extends inwardly beyond the zipper teeth of the zipper tape associated therewith, to provide zipper tapes which are positioned in staggered relationship with respect to the folded, inner end portions, so that when the interconnectable zipper teeth of the staggered zipper tapes are selectively interconnected, one folded, inner end portion substantially overhangs the zipper teeth associated with the other folded, inner end portion.

37. A method for producing an improved, generally rectangular, elongated fabric scarf construction having a substantially concealable purse, or pocket thereof, provided within the confines of overlapping fabric and positioned at or in the vicinity of at least one end portion of the scarf, which comprises:

forming a folded, inner end portion of a length of elongated fabric of generally uniform, rectangular shape having transverse outer ends and longitudinal side edges, by folding back a short marginal end portion thereof transversely across the fabric in underlapping relationship with only part of the associated remaining length thereof;

forming a folded, inner end portion of a second, substantially shorter length of fabric formed of a separate piece of fabric of generally uniform, rectangular shape having outer ends and side edges and substantially the same transverse width as that of said elongated fabric, by folding back a short marginal end thereof transversely across that fabric in underlapping relationship with only part of the associated remaining length thereof;

positioning the transverse folded edge of the respective folds of said folded, inner end portions across the scarf in transverse, substantially abutting relationship with respect to each other and stitching those edges to each other along relatively short, transverse lengths thereof extending transversely inwardly from each of the substantially abutting side edges of fabric, so as to leave a continuous, major intermediate portion of the transverse length of the substantially abutting edges unsecured to each other;

transversely positioning respective lengths of an elongated zipper tape having adjoining outer and inner side edges formed of fabric and zipper teeth, respectively, in substantially underlapping relationship with each of the two folded, inner end portions, one zipper tape being associated with one folded, inner end portion, and the other zipper tape being associated with the other folded, inner end portions, so that the respective lengths of inner side edges of zipper teeth of the two zipper tapes are substantially coextensive and are constructed and are adapted to be positioned in operative interconnecting relationship with each other along said continuous, intermediate transverse length of unsecured, substantially abutting inner edges of the folds of said folded, inner end portions, and so that one zipper tape is positioned and associated below the underlapping portion of one folded, inner end portion and the other zipper tape is positioned and associated below the underlapping portion of the other folded, inner end portion;

transversely securing the so-positioned underlapping portion of one folded, inner end portion to its associated remaining length of fabric and, at the same time, to the so-positioned, underlapping, outer side edge of fabric of its associated zipper tape, by stitching together the so-formed multi-layered fabric thereacross and thereat, and transversely securing the so-positioned underlapping portion of the other folded, inner end portion to its associated remaining length of fabric and, at the same time, to the so-positioned, underlapping, outer side edge of fabric of its associated zipper tape, by stitching together the so-formed multi-layered fabric thereacross and thereat, thereby providing a substantially coextensive length of folded, inner end portions of fabric which extend transversely across the scarf and are constructed, positioned and adapted to be placed in substantially abutting relationship and, together, to substantially overhang and thereby substantially conceal from view the zipper teeth of the zipper tapes when those teeth are selectively interconnected;

forming a first, substantially shorter length of overlapping fabric at one end of the scarf and a second, substantially shorter length of overlapping fabric at one end of the first, substantially shorter length of fabric, by folding back and thereunder, at said one end of the scarf, said elongated fabric transversely thereacross and at a distance spaced a length outwardly of said folded, inner end portion formed therefrom, to form the first, substantially shorter length of overlapping fabric, and in underlapping relationship with the length of the so-formed first, substantially shorter length of fabric and in underlapping relationship with the length of said second, substantially shorter length of fabric, and extending outwardly a substantial length beyond the outer end of said second, substantially shorter length of fabric to the other end of the scarf;

transversely securing said outer end of the second, substantially shorter length of fabric to the underlapping, elongated fabric, by stitching together the overlapping fabric thereacross and thereat, and securing together each of the side edges of the overlapping fabric formed by said first and second, substantially shorter lengths of fabric and said elongated fabric, by stitching together the overlapping fabric thereat and therealong, thereby providing a substantially concealable purse, or pocket thereof, provided by overlapping fabric formed by said elongated fabric and first and second, substantially shorter lengths of fabric, so that the pocket has an opening which is provided by the interconnectable zipper teeth of the zipper tapes, which opening may be fastened and unfastened, as desired, and through which opening an article may be selectively inserted into and withdrawn from the confines of the pocket; said opening and pocket being capable of being opened and closed upon the selective opening and closing of the interconnectable zipper teeth;

said interconnectable zipper teeth having a zipper slide member operatively associated therewith and selectively slidable with respect thereto and along a length thereof, so as to selectively and alternatively effect an intermeshing and unmeshing of the zipper teeth, whereupon the sliding movement of the slide member causes the slide member to be selectively and slidably advanced or returned to selectively fasten or close, or unfasten or open the opening to the pocket and thereby selectively provide ready access to desired inserted contents of the pocket or purse.

38. The method of claim 37, wherein a short marginal outer end of the second, substantially shorter length of fabric is folded back transversely thereacross in underlapping relationship with only part of the associated remaining length thereof, to form a folded, outer end portion of the second, substantially shorter length of fabric, and selectively thereafter transversely securing together the outer end of that fabric to the elongated fabric by stitching together the multi-layered fabric thereacross and thereat.

39. A method of producing an improved, generally rectangular, elongated fabric scarf construction having a substantially concealable purse, or pocket thereof, provided within the confines of overlapping fabric and positioned at or in the vicinity of at least one end portion of the scarf, which comprises:

providing a length of an elongated fabric of generally uniform, rectangular shape having transverse outer ends and longitudinal side edges adapted to be positioned at the outer ends and side edges, respectively, of the scarf;

forming a folded, inner end portion of a first, substantially shorter length of fabric formed of a separate piece of fabric of generally uniform, rectangular shape having outer ends and side edges and substantially the same transverse width as that of said elongated fabric, by folding back a short marginal end thereof transversely across that fabric in underlapping relationship with only part of the associated remaining length thereof;

forming a folded, inner end portion of a second, substantially shorter length of fabric formed of a separate piece of fabric of generally uniform, rectangular shape having outer ends and side edges and substantially the same transverse width as that of said elongated fabric, by folding back a short marginal end thereof transversely across that fabric in underlapping relationship with only part of the associated remaining length thereof;

positioning the transverse edges of the respective folds of said folded, inner end portions of said first and second, substantially shorter lengths of fabric in transverse, substantially abutting relationship with respect to each other and stitching those edges to each other along relatively short, transverse lengths thereof extending transversely inwardly from each of the substantially abutting side edges of fabric, so as to leave a continuous, major intermediate portion of the transverse length of the substantially abutting edges unsecured to each other;

transversely positioning respective lengths of an elongated zipper tape having adjoining outer and inner side edges formed of fabric and zipper teeth, respectively, in substantially underlapping relationship with each of the two folded, inner end portions, one zipper tape being associated with one folded, inner end portion, and the other zipper tape being associated with the other folded, inner end portion, so that the respective lengths of inner side edges of zipper teeth of the two zipper tapes are substantially coextensive and are constructed and are adapted to be positioned in operative interconnecting relationship with each other along said continuous, intermediate transverse length of unsecured, substantially abutting inner edges of the folds of said folded, inner end portions, and so that one zipper tape is positioned and associated below the underlapping portion of one folded, inner end portion and the other zipper tape is positioned and associated below the underlapping portion of the other folded, inner end portion;

transversely securing the so-positioned underlapping portion of one folded, inner end portion to its associated remaining length of fabric and, at the same time, to the so-positioned, underlapping, outer side edge of fabric of its associated zipper tape, by stitching together the so-formed multi-layered fabric thereacross and thereat, and transversely securing the so-positioned underlapping portion of the other folded, inner end portion to its associated remaining length of fabric and, at the same time, to the so-positioned, underlapping, outer side edge of fabric of its associated zipper tape, by stitching together the so-formed multi-layered fabric thereacross and thereat, thereby providing a substantially coextensive length of folded, inner end portions of fabric which are adapted to extend transversely across the scarf and are constructed, positioned and adapted to be placed in substantially abutting relationship and, together, to substantially overhang and thereby substantially conceal from view the zipper teeth of the zipper tapes when those teeth are selectively interconnected;

positioning the so-connected lengths of the first and second, substantially shorter lengths of fabric, with their associated, underlapping, secured-in-place zipper tapes, in overlapping relationship with a length of said elongated fabric and at one end thereof, so that the outer end of the first, substantially shorter length of fabric is positioned at an outer end of the elongated fabric, the other outer end of the elongated fabric extends outwardly a substantial length beyond the outer end of the second, substantially shorter length of fabric, and the overlapping outer end and side edges of the overlapping fabric are positioned at an outer end and side edges, respectively, of the scarf;

transversely securing said so-positioned outer ends of the first and second, substantially shorter lengths of fabric to the underlapping, elongated fabric, by stitching together the overlapping fabric thereacross and thereat, and securing together each of the side edges of the overlapping fabric formed by said first and second, substantially shorter lengths of fabric and said elongated fabric, by stitching together the overlapping fabric thereat and therealong, thereby providing a substantially concealable purse, or pocket thereof, provided by overlapping fabric formed by said elongated fabric and first and second, substantially shorter lengths of fabric, so that the pocket has an opening which is provided by the interconnectable zipper teeth of the zipper tapes, which opening may be fastened and unfastened, as desired, and through which opening an article may be selectively inserted into and withdrawn from the confines of the pocket; said opening and pocket being capable of being opened and closed upon the selective opening and closing of the interconnectable zipper teeth;

said interconnectable zipper teeth having a zipper slide member operatively associated therewith and selectively slidable with respect thereto and along a length thereof, so as to selectively and alternatively effect an intermeshing and unmeshing of the zipper teeth, whereupon the sliding movement of the slide member causes the slide member to be selectively and slidably advanced or returned to selectively (a) fasten or close, or (b) unfasten or open the opening to the pocket and thereby selectively provide ready access to desired inserted contents of the pocket or purse.

* * * * *